US005318126A

United States Patent [19]

Edwards et al.

[11] Patent Number: 5,318,126

[45] Date of Patent: Jun. 7, 1994

[54] EXPLOSIVELY OPENED PRODUCTION VALVE INCLUDING A FRANGIBLE BREAKUP ELEMENT OPERATED BY TUBING PRESSURE OR RATHOLE PRESSURE OR BOTH

[75] Inventors: A. Glen Edwards, Hockley; Joe C. Hromas; Klaus B. Huber, both of Sugar Land, all of Tex.

[73] Assignee: Schlumberger Technology Corporation, Houston, Tex.

[21] Appl. No.: 955,816

[22] Filed: Oct. 2, 1992

Related U.S. Application Data

[63] Continuation-in-part of Ser. No. 32,817, Mar. 16, 1993, which is a continuation of Ser. No. 858,400, Mar. 26, 1992, abandoned.

[51] Int. Cl.[5] ..... E21B 34/08; E21B 43/116; E21B 43/12

[52] U.S. Cl. ..... 166/297; 137/70; 166/55.1; 166/63; 166/299; 166/317; 166/332; 166/386

[58] Field of Search ..... 166/297, 55.1, 317, 166/332, 386, 299, 63; 137/68.2, 70, 71; 175/4.52, 4.54

[56] References Cited

U.S. PATENT DOCUMENTS

| | | | |
|---|---|---|---|
| 2,674,313 | 4/1954 | Chambers | 166/63 |
| 3,208,355 | 9/1965 | Baker et al. | 137/70 X |
| 3,209,937 | 10/1965 | Hirst et al. | 137/70 X |
| 3,589,442 | 6/1971 | Kilgore | 166/63 |
| 4,515,217 | 5/1985 | Stout | 166/297 |
| 4,557,331 | 12/1985 | Stout | 166/297 |
| 4,603,741 | 8/1986 | Edgmon | 166/369 |
| 4,616,701 | 10/1986 | Stout et al. | 166/55.1 |
| 4,616,718 | 10/1986 | Gambertoglio | 175/4.54 |
| 4,905,759 | 3/1990 | Wesson et al. | 166/377 X |

OTHER PUBLICATIONS

Book entitled "Schlumberger Tubing Conveyed Perforating", dated 1988, pp. 4–7 and 4–8.

*Primary Examiner*—Hoang C. Dang

*Attorney, Agent, or Firm*—Henry N. Garrana; John H. Bouchard

[57] ABSTRACT

A production valve includes an outer housing having a production port, a piston disposed within the outer housing and adapted to move from one position to another position, a frangible breakup element supporting the piston in the one position, and a detonating cord adapted for propagating a detonation wave passing through the center of the piston and the breakup element. The detonation wave shatters the frangible breakup element when the detonation wave, propagating within the detonating cord, passes through the breakup element. When the breakup element shatters, the support provided to the piston by the breakup element is removed. When the support provided to the piston by the breakup element is removed, the piston moves from the one position to the other position in response to either tubing pressure or rathole pressure or both, and the production port of the production valve opens when the piston moves to the other position.

21 Claims, 2 Drawing Sheets

EXPLOSIVELY OPENED PRODUCTION VALVE INCLUDING A FRANGIBLE BREAKUP ELEMENT OPERATED BY TUBING PRESSURE OR RATHOLE PRESSURE OR BOTH

This is a continuation-in-part of application Ser. No. 08/032,817 filed Mar. 6, 1993, which is a continuation of application Ser. No. 07/858,400 filed Mar. 26, 1992 now abandoned.

BACKGROUND OF THE INVENTION

The subject matter of the present invention relates to a method and apparatus for explosively opening a production valve of a tool string adapted to be disposed in a wellbore, and more particularly, to an apparatus and associated method which includes a frangible breakup element that is adapted to shatter into a multitude of pieces when a detonation wave passes therethrough, a support, applied to a piston, being removed when the frangible breakup element shatters, the piston moving in response to a tubing pressure or a rathole pressure when the support, applied to the piston, is removed, the production valve opening when the piston moves a predetermined distance.

A tool string, adapted to be disposed in a wellbore, often includes a production valve, a firing head, and a perforating gun. The production valve can be connected between the firing head and the perforating gun in the tool string when disposed in the wellbore, or the firing head can be connected between the production valve and the perforating gun. When the perforating gun detonates, the production valve should be open in order to create an underbalance condition and permit well fluids to flow into the production valve and into the associated tubing. One of the advantages of using tubing conveyed perforating (TCP) is the ability of shoot the perforating gun in the wellbore while the well is underbalanced. The most common way to shoot while underbalanced is to use a production valve. These valves are operated (that is, opened) downhole at the appropriate time by various means, such as by dropping a weight bar from the surface which breaks off a frangible member thereby allowing pressure from either the rathole or the tubing to work on a piston and opening the production ports of the production valve. In shallow wells, where the pressure is relatively low, a problem occasionally arises when the production valve opens, that is, a resultant pressure transient in the well causes a decrease in pressure inside the tubing string and hence at the firing head that can prevent a pressure assisted firing head in the perforating gun from functioning properly The resultant pressure transient can produce a low or negative pressure in the vicinity of a firing pin of the firing head of the perforating gun at precisely the time when the firing pin of the firing head in required to move for firing the perforating gun. Still other production valves, used in association with pressure assisted firing heads, are also operated by pressure. These valves also have inherent problems in that most rely on shear pins to retain the valve in the closed condition; however, the shear pins must shear immediately prior to the firing the perforating gun. In addition, the use of a pressure operated valve in a tool string increases the total operating pressure necessary to actuate the firing head; however, the equipment located downhole in the wellbore may not be strong enough to withstand these higher operating pressures.

SUMMARY OF THE INVENTION

Accordingly, it is a primary object of the present invention to provide a production valve which is constructed to avoid all of the aforementioned problems, discrepancies, and disadvantages associated with prior art production valves.

It is a further object of the present invention to provide a production valve which includes a frangible breakup element that is designed to shatter into a multitude of pieces when a detonation wave, propagating in a detonating cord, passes through the frangible breakup element, the breakup element initially providing support to a piston which maintains a production port of the production valve in a closed condition, the shattering of the breakup element removing the support to the piston thereby allowing the piston to move in response to a tubing pressure or a rathole pressure or both, the production port opening when the piston moves a predetermined distance.

In accordance with these and other objects of the present invention, a production valve includes an outer housing having a production port, a piston disposed within the outer housing and adapted to move from one position to another position, the port being closed when the piston is disposed in the one position, the port being open when the piston is disposed in the other position, a frangible breakup element supporting the piston in the one position, and a detonating cord adapted for propagating a detonation wave passing through the center of the piston and the breakup element, the detonation wave shattering the frangible breakup element when the detonation wave propagating within the detonating cord passes through the breakup element, the support provided to the piston by the breakup element being removed when the breakup element shatters, the piston moving from the one position to the other position when the support provided to the piston is removed, and the production port of the production valve opening when the piston moves to the other position.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented herinbelow, and the accompanying drawings, which are given by way of illustration only and are not intended to be limitative of the present invention, and wherein.

DETAILED DESCRIPTION OF THE PREFERRED EMBODIMENT

Figure 1:
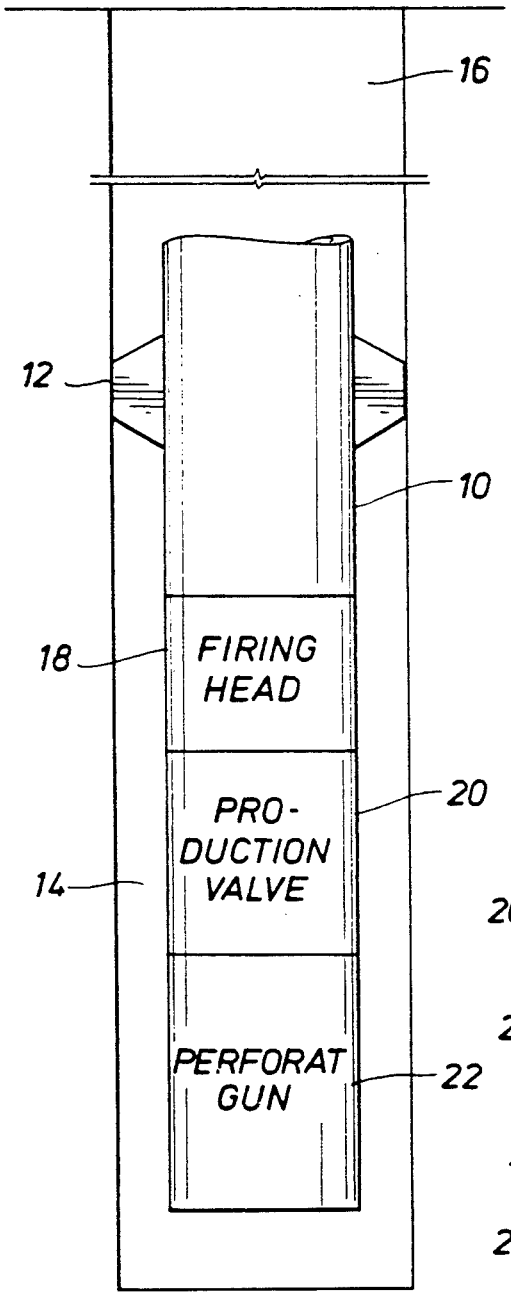
FIG. 1 illustrates a production valve connected between a firing head and a perforating gun in a wellbore.

Referring to FIG. 1, a tubing string 10 is disposed in a wellbore. A packer 12 isolates a rathole annulus 13 from an above packer annulus 16. A firing head 18 is connected to tubing 10, a production valve 20 is connected to the firing head 18, and a perforating gun 22 is connected to the production valve 20. In operation, when the firing head 18 detonates, a detonation wave begins to propagate within a detonating cord connected to the firing head. The detonating cord passes through the production valve 20 and the perforating gun 22. When the denovation wave passes through the production valve 20, the valve 20 opens thereby communicating the rathole annulus 14 to the internal portion of the tubing 10 and creating an underbalanced condition within the rathole annulus 14. When the detonating ave reaches the perforating gun 22, the perforating gun 22 detonates thereby perforating gun 22, the perforating gun 22 detonates thereby perforating a formation traversed by the well bore. Well fluid produced from the formation enters the rathole annulus 14 and then enters the opened production valve 20. The well fluid then enters the internal portion of tubing 10 and propagates uphold to the wellbore surface.

Referring to FIGS. *2a–2c*, a detailed construction of the production valve 20 of FIG 1, in accordance with the present invention, is illustrated.

In FIG. *2a*, the production valve 20 includes a housing 20*a* and production ports 20*b* disposed through a wall of the housing 20*a*, the ports 20*b* having a port cavity 20*b*1. A piston 20*c* is disposed within the housing 20*a*. A detonating cord tube 24 is sealingly connected to one end of the piston 20*c*, the detonating cord tube receiving a detonating cord 26. The piston 20*c* includes a bore in which the detonating cord 26 is disposed, the detonating cord from the detonating cord tube 24 passing through the piston 20*c* of the valve 20 and ultimately being connected to the shaped charges disposed within the perforating gun 22. The piston 20*c* is supported, on its other end, by a frangible breakup element 20*e* (FIG. *2b*), in accordance with the present invention, which prevents the piston 20*c* from moving downwardly within the housing 20*a*. A shoulder 20*i* prevents the piston 20*c* from moving upwardly within the housing 20*a*. If the piston 20*c* were not supported by the frangible breakup element 20*e*, the piston 20*c* would be movable downwardly within the housing 20*c* ; from one position, where the ports 20*b* are closed as shown in FIG. *2a* , to another position, where the ports 20*b* are open. A first pair of o-rings 20*d*and 20d2 seal the piston 20*c* to the housing 20*a* and close off the production ports 20*b* when the piston 20*c* is disposed in the one position shown in FIG. *2a*. When the piston 20*c* is disposed in the one position, as shown in FIG. *2a*, one o-ring 20d1 is disposed on one side of the port 20*b*, the other o-ring 20d2 being disposed on the other side of the port 20*b*. As a result, when the production ports 20*b* are sealed off as shown in FIG. *2a*, the production ports 20*b* are closed, the rathole annulus 14 is not in an underbalanced condition, and the rathole annulus 14 cannot fluidly communicate with the internal portion of the tubing 10.

A first space 20*f*, disposed between the piston 20*c* and the housing 20*a*, is defined by an internal surface of housing 20*a*, an external surface of piston 20*c*, and a first working surface 20c1 of the piston 20*c*. The first working surface 20c1 of piston 20*c* is subject to the pressure of fluids disposed within the tubing 10 (tubing pressure). The piston 20*c* includes a second working surface 20c2, disposed within the cavity 20b1 of the production ports 20*b*, which is subject to the pressure of fluids disposed within the rathole annulus 14 (rathole pressure). An air chamber 20*g* is defined by another internal surface of the housing 20*a*, another external surface of piston 20*c*, and a third surface 20c3 of the piston 20*c*. The air chamber 20*g* is provided to assist the tubing and rathole pressures in overcoming any pressure built up in a breakup chamber 20*h* (FIG. *2b*).

In FIG. *2b*, the housing 20*a* is threadedly and sealingly connected to a second housing 20a1, the housing 20*a* enclosing the air chamber 20*g* and an enlarged portion 20g1 of the air chamber 20*g*, the second housing 20a1 enclosing the breakup chamber 20*h*. The second housing 20a1 is also sealingly connected, via an o-ring 20*j*, to piston 20*c*. The housing 20*a* and second housing 20a1 also enclose the piston 20*c* and the frangible breakup element 20*e* in accordance with the present invention. The frangible breakup element 20*e* is actually comprised of a plurality of individual breakup elements 20e1, 20e2, . . . , 20e4, . . . , 20e10 connected together in serial fashion, where each individual breakup element is comprised of the following material: gray-iron class 40 (spec number ASTM A48-76), otherwise more commonly known as grade 40 cast iron. The detonating cord 26, adapted for propagating a detonation wave, passes through the center of the piston 20*c* and frangible breakup element 20*e*. The material of the frangible breakup element 20*e* is specifically designed to shatter into a multitude of pieces when the detonation wave, propagating within the detonating cord 26, passes through the frangible breakup element 20*e*, The remaining parts of the production valve 20, such as the housings and the piston, are comprised of alloy steel. As shown in FIG. *2b*, as long as the frangible breakup element 20*e* is intact, it provides support for the piston 20*c*, preventing the piston 20*c* from moving downwardly in FIG. *2b*. However, when the breakup elements 20*e* shatter in response to a detonation wave propagating within the detonating cord 26 disposed within the breakup element 20*e*, the support for the piston 20*c* is removed and the piston 20*c* is free to move downwardly in FIG. *2b* in response to either tubing pressure or rathole pressure or both.

In FIG. *2c*, the second housing 20a1 is sealingly connected via o-rings 20L and threadedly connected to a third housing 20a2, the second housing 20a1 being further threadedly connected to a breakup adaptor 20*k*. The breakup adaptor 20*k* includes a recess 20k1 for holding and supporting the frangible breakup elements 20*e*. The detonating cord 26 passes through the center of the frangible breakup elements 20*e* and the breakup adaptor 20*k*. The third housing 20a2 includes a bleed valve a2A for allowing safe disassembly of the tool should debris from either the breakup element 20*e* or other parts of the perforating gun 22 prevent dispersal of the pressures of detonation prior to exiting the wellbore following completion of the perforating job. The third housing 20a2 encloses a first sub-housing 20a3 and a second sub-housing 20a4, which sub-housings further enclose the detonating cord 26 which passes through the center of the production valve 20, and position a donor booster 27 to initiate the perforating gun 22.

A functional description of the operation of the production valve 20, and particularly the frangible breakup elements 20*e* of the production valve 20, in accordance with the present invention, is set forth in the following paragraphs with reference to FIGS. 1 and 2*a*–2*c* of the drawings.

Figure 2A:
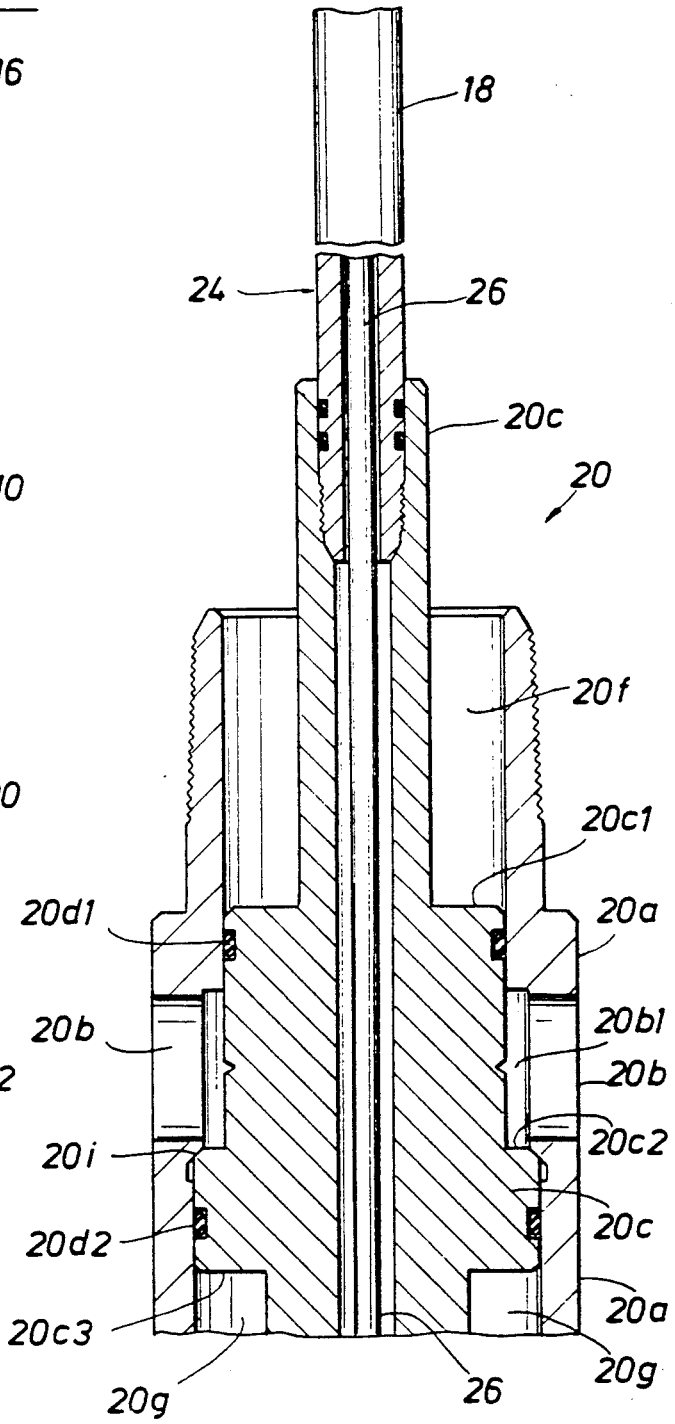
FIGS. 2*a*–2*c* illustrate a detailed construction of the production valve of FIG. 1 in accordance with the present invention.
Figure 2B:
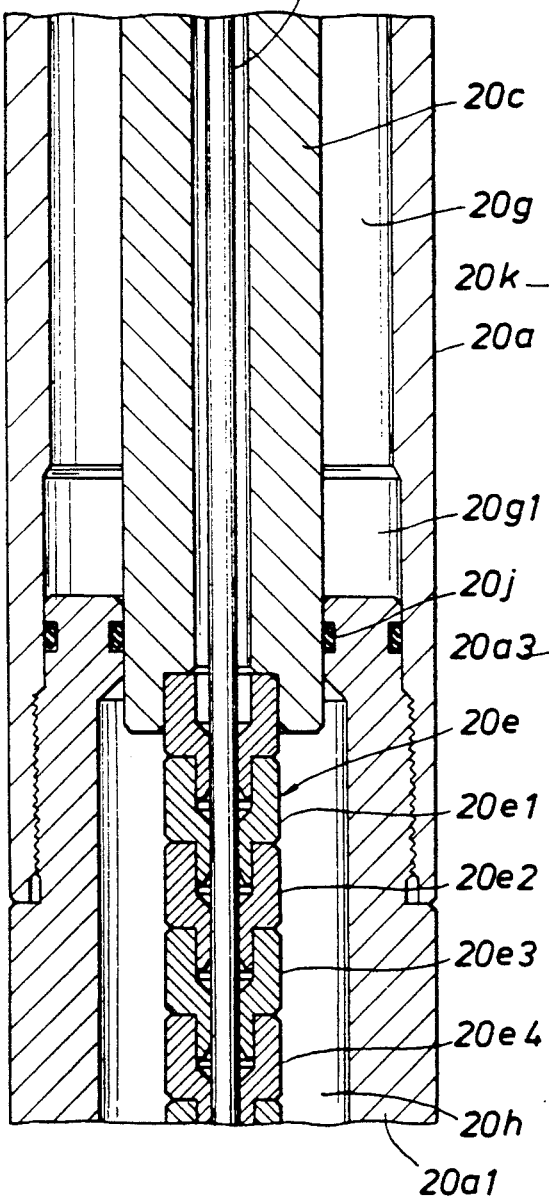
Figure 2C:
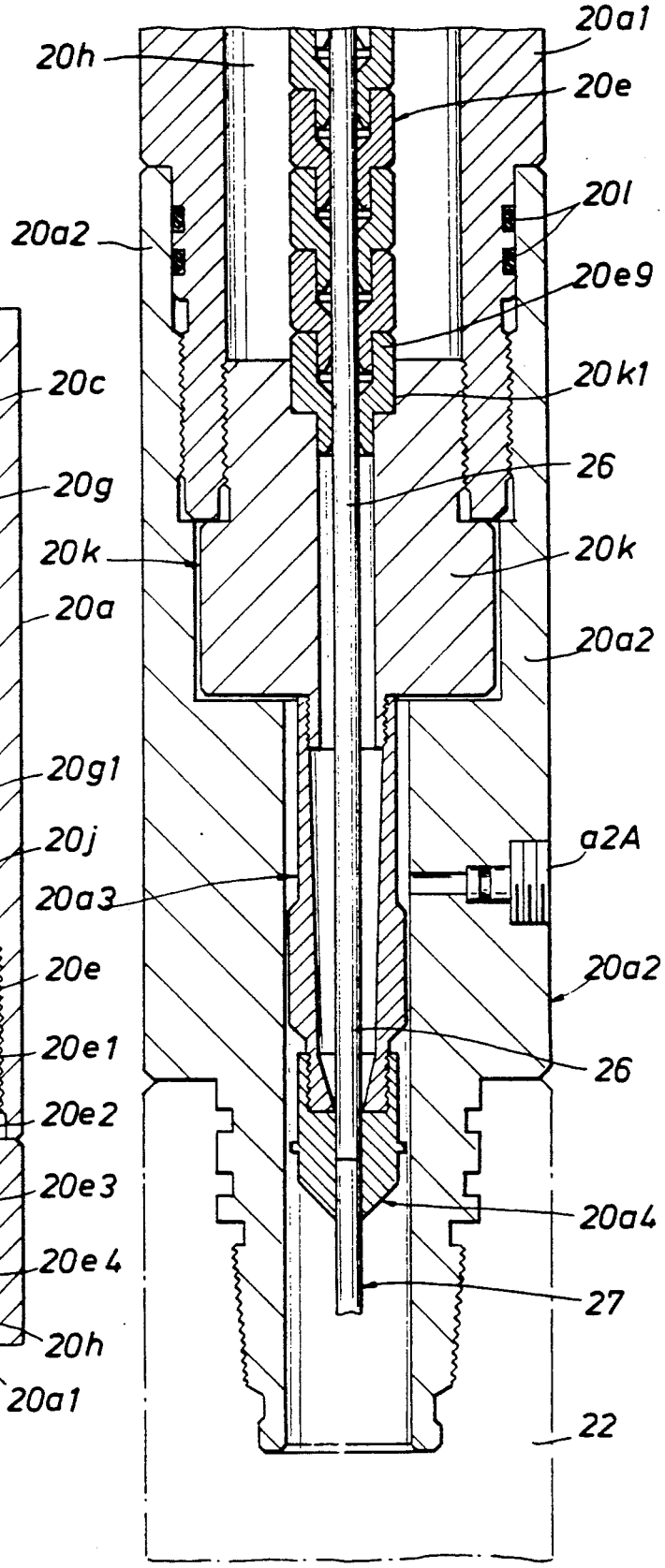

In FIGS. 2*a*–2*c*, when the firing head 18 (such as a trigger charge firing head or a hydraulic time delay firing head) detonates, the detonation will initiate the propagation of a detonation wave within the detonating cord 26. The detonation wave will propagate down the detonating cord 26, through the center of the detonating cord tube 20*c*, through the center of piston 20*c*, through the center of the frangible breakup elements 20*e*, through the center of breakup adaptor 20*k*, through the center of sub-housings 20a3 and 20a4, and toward the shaped charges disposed within the perforating gun 22. Initially, the piston 20*c* is disposed in its one position, supported in this position by the frangible breakup elements 20*e*, which position is shown in FIG. 2*a* of the drawings. In this position, the production ports 20*b* are closed and the o-rings 20d1 and 20d2 effectively seal off any fluid communication which may exist between the rathole annulus 14 the internal portion of tubing 10. However, in accordance with the present invention, when the detonation wave propagating within detonating cord 26 passes through the center of the frangible breakup elements 20*e*, due to the material (cast iron) of which the breakup elements 20*e* are made, all of the individual breakup elements 20*e* will shatter into a multitude of pieces. When the breakup elements 20*e* shatter, the debris from the breakup elements 20*e* will fall into the breakup chamber 20*h*. At this point, the piston 20*c* is no longer supported by the breakup elements. Although the shoulder 20*i* prevents the piston 20*c* from moving upwardly, since the breakup elements 20*e* have already shattered, there is nothing to prevent the piston 20*c* from moving downwardly in FIGS. 2*a*–2*c*. Recall that tubing pressure is acting on the first working surface 20c1 in FIG. 2*a*, and that rathole pressure is acting on the second working surface 20c2 in FIG. 2*a*. Therefore, the piston 20*c* will now move downwardly in response to either the tubing pressure or the rathole pressure acting on either one or both of working surfaces 20c1 and/or 20c2. When the piston 20*c* moves downwardly by a predetermined distance, o-ring 20d1 of piston 20*c* passes by the shoulder 20*i* of housing 20*a* thereby opening a fluid communication path between rathole annulus 14 and the internal portion of tubing 10. An underbalanced condition is now achieved in rathole annulus 14. As a result, when the detonation wave in detonating cord 26 reaches the shaped charges in the perforating gun 22, the gun 22 detonates. Since an underbalanced condition exists in the rathole annulus 14, the well fluid produced from the formation will flow into production ports 20*b* of the production valve 20 and uphole to the wellbore surface.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A production valve adapted to be disposed in a wellbore, comprising:

a housing including a wall, a port being disposed through said wall;

a piston disposed within said housing and adapted to move from one position to another position, said port being blocked by said piston and closed when said piston is in said one position, said port not being blocked by said piston and open when said piston is in said another position;

frangible member means adapted to change from an intact condition to a shattered condition for holding and supporting said piston in said one position when said frangible member means is in said intact condition; and a detonating cord disposed within said piston and said frangible member means, a detonation wave adapted to propagate within said detonating cord, said frangible member means changing from said intact condition to said shattered condition when the detonation wave passes through said frangible member means, the support provided by said frangible member means to said piston being removed when said frangible member means changes to said shattered condition, said piston adapted to move to said another position when the support is removed.

2. The production valve of claim 1, wherein said frangible member means comprises a plurality of individual frangible members connected together in serial fashion.

3. A tool string adapted to be disposed in a wellbore, comprising:

firing head means connected to a detonating cord for initiating a detonation wave in said detonating cord:

perforating gun means for perforating a formation traversed by said wellbore and producing well fluids from said formation; and valve means connected between said firing head means and said perforating gun means and responsive to said detonation wave propagating in said detonating cord for changing from a closed condition to an open condition in response to said detonation wave, said valve means including, a housing having a production port, a piston adapted to be disposed in one position within said housing thereby blocking said production port and maintaining said closed condition of said valve means, frangible member means responsive to said detonation wave for holding and supporting said piston in said one position within said housing, said frangible member means shattering in response to said detonation wave thereby removing the support to said piston and enabling said piston to move from said one position to another position, the block of said production port being removed and said valve means changing from said closed condition to said open condition when said piston moves from said one position to said another position.

4. The tool string of claim 3, wherein said detonating cord is disposed within said piston and said frangible member means, said frangible member means shattering when said detonation wave propagating within said detonating cord passes through said frangible member means.

5. The tool string of claim 4, wherein said frangible member means is comprised of a cast iron material.

6. A method of changing the state of a valve connected to a tubing and adapted to be disposed in a wellbore, said valve including a piston and a frangible member supporting said piston, a detonating cord adapted for propagating a detonation wave being disposed within said frangible member, a rathole being disposed around said valve and said tubing in said wellbore, a first pressure existing in said rathole and a second pressure existing in said tubing, comprising the steps of:

propagating said detonation wave through said detonating cord;

shattering said frangible member in response to said detonation wave propagating in said detonating cord;

moving said piston when the frangible member is shattered in response to either said first pressure in said rathole or said second pressure in said tubing; and changing the state of said valve when said piston moves a predetermined distance.

7. The method of claim 6, wherein the state of said valve is changed from a closed state to an open state when the frangible member shatters and said piston moves said predetermined distance.

8. A device adapted to be disposed within a wellbore for changing from a closed condition to an open condition, comprising:

a housing having a port;

piston means disposed within said housing and initially disposed in one position within said housing for blocking said port in said housing and maintaining said device in said closed condition;

frangible means disposed within said housing for supporting said piston means in said one position thereby blocking said port and maintaining said device in said closed condition; and a detonating cord disposed within said frangible means, a detonation wave adapted to propagate within said detonating cord, said frangible means shattering in response to said detonation wave in said detonating cord, the support provided to said piston means by said frangible means being removed when said frangible means shatters, said piston means moving away from said port in said housing when said frangible means shatters, said device changing from said closed condition to said open condition when said piston means moves away from said port.

9. The device of claim 8, wherein said device is a valve.

10. A device adapted to be disposed in a wellbore, comprising:

a housing including a wall, a port being disposed through said wall;

a piston disposed within said housing and adapted to move from one position to another position, said port being blocked by said piston and closed when said piston is in said one position, said port not being blocked by said piston and open when said piston is in said another position;

frangible member means adapted to change from an intact condition to a shattered condition for holding and supporting said piston in said one position when said frangible member means is in said intact condition; and a detonating cord disposed within said piston and said frangible member means, a detonation wave adapted to propagate within said detonating cord, said frangible member means changing from said intact condition to said shattered condition when the detonation wave passes through said frangible member means, the support provided by said frangible member means to said piston being removed when said frangible member means changes to said shattered condition, said piston adapted to move to said another position when the support is removed.

11. The device of claim 10, wherein said device is a production valve, said frangible member means including a plurality of individual frangible members connected together in serial fashion.

12. An apparatus adapted to be disposed in a wellbore, comprising:

first means connected to a detonating cord for initiating a detonation wave in said detonating cord; second means for receiving said detonation wave from said detonating cord; and third means connected between said first means and said second means and responsive to said detonation wave propagating in said detonating cord for changing from a closed condition to an open condition in response to said detonation wave, said third means including, a housing having a production port, a piston adapted to be disposed in one position within said housing thereby blocking said production port and maintaining said closed condition of said third means, frangible member means responsive to said detonation wave for holding and supporting said piston in said one position within said housing, said frangible member means shattering in response to said detonation wave thereby removing the support to said position and enabling said piston to move from said one position to another position, the block of said production port being removed and said third means changing from said closed condition to said open condition when said piston moves from said one position to said another position

13. The apparatus of claim 12, wherein said first means is a firing head, said second means is a perforating gun, and said third means is a valve.

14. The apparatus of claim 12, wherein said detonating cord is disposed within said piston and said frangible member means, said frangible member means shattering when said detonation wave propagating within said detonating cord passes through said frangible member means.

15. The apparatus of claim 14, wherein said frangible member means is comprised of a cast iron material.

16. A method of opening a port in a housing adapted to be disposed in a wellbore, comprising the steps of:

propagating a detonation wave through a detonating cord, said cord being enclosed by a frangible member;

in response to the detonation wave propagating in said detonating cord, shattering said frangible member;

when the frangible member is shattered, removing a support applied to a piston;

when the support is removed, moving the piston in response to an applied pressure, said piston initially blocking said port in said housing and moving a predetermined distance away from said port in response to said pressure; and when the piston moves said predetermined distance away from said port, opening said port in said housing.

17. The method of claim 16, wherein said housing is connected to a tubing, said applied pressure being a tubing pressure in said tubing, the moving step comprising the step of:

moving said piston said predetermined distance in response to said tubing pressure in said tubing.

18. The method of claim 16, wherein said housing and said wellbore define a rathole when said housing is disposed in said wellbore, a rathole pressure existing within said rathole, the moving step comprising the step of:

moving said piston said predeterminged distance in response to said rathole pressure in said rathole.

19. The method of claim 16, wherein said frangible member includes a plurality of serially connected frangible parts, the shattering step comprising the step of:

in response to said detonation wave propagating in said detonating cord, serially shattering each of said plurality of serially connected frangible parts of said frangible member.

20. The method of claim 19, wherein said housing is connected to a tubing, said applied pressure being a tubing pressure in said tubing, the moving step comprising the step of:

moving said piston said predetermined distance in response to said tubing pressure in said tubing.

21. The method of claim 19, wherein said housing and said wellbore define a rathole when said housing is disposed in said wellbore, a rathole pressure existing within said rathole, the moving step comprising the step of:

moving said piston said predetermined distance in response to said rathole pressure in said rathole.

* * * * *